United States Patent [19]

Schreiner et al.

[11] Patent Number: 4,609,525

[45] Date of Patent: Sep. 2, 1986

[54] CADMIUM-FREE SILVER AND METAL OXIDE COMPOSITE USEFUL FOR ELECTRICAL CONTACTS AND A METHOD FOR ITS MANUFACTURE

[75] Inventors: Horst Schreiner; Bernhard Rothkegel, both of Nuremberg, Fed. Rep. of Germany

[73] Assignee: Siemens Aktiengesellschaft, Munich, Fed. Rep. of Germany

[21] Appl. No.: 799,183

[22] Filed: Nov. 15, 1985

Related U.S. Application Data

[63] Continuation of Ser. No. 738,894, May 29, 1985, abandoned, which is a continuation of Ser. No. 444,340, Nov. 24, 1982, abandoned.

[30] Foreign Application Priority Data

Nov. 26, 1981 [DE] Fed. Rep. of Germany ..... 3146972

[51] Int. Cl.[4] ..... B22F 3/16; B22F 7/02

[52] U.S. Cl. ..... 419/6; 419/19; 419/21; 419/23; 419/31; 419/54

[58] Field of Search ..... 75/951, 234; 148/431; 419/6, 21, 33, 19, 23, 57, 31, 30, 54; 428/546, 553, 564, 565

[56] References Cited

U.S. PATENT DOCUMENTS

| | | | |
|---|---|---|---|
| 2,425,053 | 8/1947 | Swinehart | 419/21 |
| 3,385,677 | 5/1968 | Schreiner et al. | 419/21 |
| 3,578,443 | 5/1971 | Grant et al. | 75/951 |
| 3,649,242 | 3/1972 | Arias | 419/33 |
| 3,709,667 | 1/1973 | Selman et al. | 75/234 |
| 3,741,748 | 6/1973 | Fustukian et al. | 419/33 |
| 3,859,087 | 1/1975 | Backstrom | 419/23 |
| 3,874,941 | 4/1975 | Shibata | 148/431 |
| 3,933,486 | 1/1976 | Shibata | 148/431 |
| 3,954,459 | 5/1976 | Schreiner et al. | 419/21 |
| 3,976,482 | 8/1976 | Larson | 419/23 |
| 4,050,930 | 9/1977 | Motoyoshi et al. | 148/431 |
| 4,131,458 | 12/1948 | Satoh et al. | 148/431 |
| 4,141,727 | 2/1979 | Shida et al. | 75/234 |
| 4,150,982 | 4/1979 | Shibata | 148/431 |
| 4,161,403 | 7/1979 | Shibata | 148/431 |
| 4,242,135 | 12/1980 | Shibata | 148/431 |
| 4,243,413 | 1/1981 | Shibata | 419/21 |
| 4,274,873 | 6/1981 | Nadkarni | 419/23 |
| 4,341,556 | 7/1982 | Bohm et al. | 148/431 |

FOREIGN PATENT DOCUMENTS

| | | | |
|---|---|---|---|
| 2824117 | 12/1979 | Fed. Rep. of Germany | 419/21 |
| 128525 | 11/1978 | Japan | 419/21 |
| 43775 | 3/1980 | Japan | 75/234 |
| 87641 | 7/1981 | Japan | 419/21 |
| 90940 | 7/1981 | Japan | 148/431 |
| 90941 | 7/1981 | Japan | 148/431 |
| 102536 | 8/1981 | Japan | 148/431 |
| 1397319 | 6/1975 | United Kingdom | 419/23 |
| 1444199 | 7/1976 | United Kingdom | 419/21 |
| 2093066 | 8/1982 | United Kingdom | 148/431 |

*Primary Examiner*—Melvyn J. Andrews
*Assistant Examiner*—John J. Zimmerman
*Attorney, Agent, or Firm*—Kenyon & Kenyon

[57] ABSTRACT

The composite according to the invention is prepared by milling an atomized silver, two metal oxide alloy powder dry or wet in a mill in order to reduce its particle size and deform its particle shape. Subsequently an internal oxidation of the powder is carried out in two stages, at a first temperature range between 673° K. and 773° K. for two to six hours and in a second temperature range between 873° K. and 1073° K. for 0.5 to 2 hours. The internally oxidized powder is pressed into molded parts and these are densified by sintering in a temperature range between 973° K. and 1173° K. in air or a neutral atmosphere and by coining.

8 Claims, 2 Drawing Figures

CADMIUM-FREE SILVER AND METAL OXIDE COMPOSITE USEFUL FOR ELECTRICAL CONTACTS AND A METHOD FOR ITS MANUFACTURE

This application is a continuation of application Ser. No. 738,894 filed May 29, 1985 now abandoned, which is a continuation of Ser. No. 444,340, filed 11-24-82, now abandoned.

BACKGROUND OF THE INVENTION

The invention relates to a composite of silver and at least two metal oxides manufactured by milling, sintering and compressing a powder thereof. The composite is useful as a contact layer of a two layer electrical contact, the other layer having good soldering or welding characteristics.

In many high current density applications, highly conductive metals, such as silver, are not suited for use as a material for electrical contact elements. The surface of such a metal will frequently become partially melted and splattered in the arc which is generated in switching processes, particularly if the contacts chatter when being closed. This leads to a large amount of material burn-off and also can cause the contact elements to weld together so that they can be separated only be application of a force (known as the welding force). As a result, such contact elements are typically hardened by addition of a metal oxide.

In particular, cadmium oxide has been used as a metal oxide component for hardening silver electrical contacts. This type of element has good heat resistive characteristics and does not exhibit material flow. However, while contact elements of silver and cadmium oxide are useful for large current carrying applications, they also are undesirable. Their manufacture requires use of cadmium and cadmium salts which are poisonous and make disposal of the manufacturing wastes difficult. Moreover, their use in large electrical devices causes cadmium environmental pollution and cadmium toxification of workers repairing such devices unless special precautions are taken.

Nevertheless, contact elements of silver and a metal oxide other than cadmium oxide have not been developed which can meet electrical contact property specifications required for large electrical contact devices. For example, a contact element made of a silver and tin oxide dispersion exhibits in extruded form an unacceptably high temperature rise and material migration parallel to its extrusion dimension when it is used to carry large current. While excessive temperature rise can be reduced by addition of tungsten oxide ($WO_3$), the material migration still occurs. It is only when a silver and tin oxide contact element carries current perpendicular to its extrusion dimension that practically no material migration will occur. This arrangement, however, cannot be used because a method for bonding or soldering the contact to its support has not yet been developed.

SUMMARY OF THE INVENTION

It is, therefore, an object of the invention to produce a composite of silver and metal oxide which is useful as an electrical contact and conductor element and which will not cause a large amount of environmental pollution. It is a further object to produce a silver and metal oxide composite which is relatively safe to handle without the use of special techniques or procedures. Yet another object is to produce electrical contact element which will not generate difficult to handle manufacturing waste. A specific object is to produce a cadmium-free silver and metal oxide composite for use as a contact element which has approximately the same physical properties as a contact element made of a silver and cadmium oxide composition.

Accordingly, the invention is directed to a composite comprising first and second metal oxides dispersed in silver which is free of cadmium oxide. The first and second metal oxides are present in amounts of from about 12 to 25 volume percent and 0.1 to 2 volume percent respectively relative to the volume of the composite. The first oxide is selected from zinc oxide or tin oxide and second metal oxide is selected from bismuth oxide, lead oxide, copper oxide, indium oxide or a mixture of any two or more of these oxides. The silver constitutes the remaining volume percent of the composite.

The composite has a macromolecular structure wherein the two metal oxides are are least in part in the form of microscopic particles which are substantially uniformly dispersed throughout a silver metal lattice. The metal oxide particles have a size range of about 2 microns or less. Typically, there will be two sizes: those less than 0.5 microns and those from about 0.5 to 2 microns.

A layer of composite can be combined with a layer of silver or similar solderable or weldable metal to form a two layer material which can be used as an electrical contact or conductor. The composite is the contact layer and the silver is the layer soldered or welded to a support.

The composite is prepared by forming a metal alloy of silver and first and second metals corresponding to the metal ions of the first and second metal oxides. The amounts of silver and first and second metals used are calculated to yield the appropriate volume percents in the composite. The metal alloy is comminuted by atomizing it under pressure through a small orifice into a water chamber. Small, solid, somewhat spherically shaped alloy particles having an average diameter of less than 0.2 mm are formed by this process. These particles are subsequently milled to reduce their sizes and deform their shapes into elongated, platlet shaped particles having an average thickness substantially less than, and an average length greater than the spherically shaped particle average diameter. After milling, the platlet particles are oxidized by heating in an oxygen containing atmosphere first at a temperature of about 673° K. to about 773° K. for about 2 to 6 hours and then at a temperature of about 873° K. to about 1073° K. for about 0.5 to 2 hours. The oxidation converts the first and second metals to their respective oxides. Following oxidation, the particles are pressed under pressure to form a unitary solid having a continuous overall structure and the solid is sintered in an air-like or non-oxidizing atmosphere at a temperature of from about 973° K. to about 1173° K. for about 0.5 to 2 hours to form the composite.

When a two layer material is to be formed, a second layer of solderable or weldable metal in the form of a powder is placed in the press mold on top of or underneath the oxidized platelet particles. The layered powders are pressed to form a two layer solid, one layer being the silver and metal oxide composite and the other being the solderable or weldable metal. Preferred metals for the second layer include silver and copper.

In addition to the foregoing steps, the procedure can be augmented by steps which further promote the resistance to burn-out and welding. These include remilling the oxidized platelet particles before pressing, and cold coining or stamping to decrease further the porosity.

DETAILED DESCRIPTION OF THE INVENTION

The composite of the invention is a cadmium free dispersion of metal oxides in silver which has high resistance to heat deformability, burn out and welding. It is believed that these properties are due to the macromolecular structure of the composite including the microscopic size of the oxide particles which contain at least part of the metal oxides present in the composite, their substantially uniform dispersion in the silver lattice, and the lattice orientation, which results from the milling deformation.

The macromolecular structure is believed to result from the process for formation of the composite. The desired metals are first melted together to form a melted solution, which is then solidified into small round particles comprising a solid solution of the metals, i.e., an alloy. The deformation step (milling) changes the silver lattice orientation and upon oxidation, the first and second metal oxides at least in part precipitate in the distorted silver lattice to form microscopic metal oxide particles. As a result of this method of producing a metal oxide-silver dispersion, the metal oxide particles are extremely small and highly dispersed.

When milling the silver-metal alloy powder, it is important to obtain simultaneous deformation and particle size reduction. The degree of deformation depends on the mill used, the milling time and, in the case of wet milling, also somewhat on the milling liquid. Typically the conditions employed will be those of Example 1 below. For wet milling, isopropanol and similar alkanols have been found to be particularly suitable. The degree of deformation can be described microscopically by the change of the particle shape. After particulate solidification of the melt and before the milling, the alloy powder particles exhibit a round form.

Figure 1:
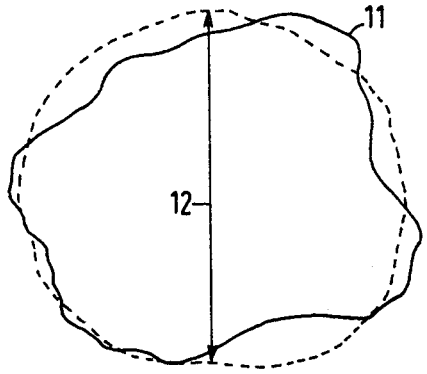
FIG. 1 shows a rounded, spherically-shaped powder particle in cross section before the milling.
Figure 2:
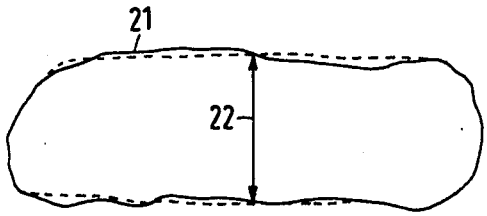
FIG. 2 shows an elongated, platelet-shaped powder particle in cross section after the milling.

In FIGS. 1 and 2, respectively, the cross sections of powder particles are shown prior to the milling (particle 11) and after the milling (particle 21). The mean diameter (12) of the round particle (11) is reduced in about one-half by the milling process and corresponds to the thickness (22) of the platelet-shaped particle (21) produced after the milling. The main criterion for the milling is the deformation, i.e., the change of the shape of the particle, during the comminution. The decrease of the mean particle diameter, on the other hand, is of secondary importance. In the milling treatment, also the bulk and tap densities are changed. The desired deformation of the powder particles can be obtained with a ball mill when using a dry milling process and with a ball stirrer when using a wet milling process.

The invention is further illustrated by the following examples.

EXAMPLE 1

A Silver, Zinc Oxide, Bismuth Oxide, Electrical Contact

A melt was made of the metals silver, zinc and bismuth wherein the composition was 91.8 weight percent Ag, 6 weight percent Zn, and 2.2 weight percent Bi. The homogenized alloy melt was comminuted into metal alloy powder by atomizing it into water. The alloy powder with a particle size of less than 0.2 mm was then milled in propanol in a ball stirrer with steel balls for 15 minutes. In this process, the powder size properties changed as follows: the bulk density changed from 3.33 g/cm$^3$ to 2.78 g/cm$^3$, the tap density changed from 4.17 g/cm$^3$ to 3.85 g/cm$^3$; the flow time in a 60° inclined cone funnel with a nozzle diameter of 4 mm changed from 20 seconds/100 g to 27 seconds/100 g. During the milling, the particle form was changed by deformation in the manner shown schematically in FIGS. 1 and 2. After the milling the powder was dried.

Internal oxidation of the powder particles was performed by heating in air, first at 673° K. for two hours and subsequently heating at 873° K. for one hour. The internal oxidation was determined to be complete when the increase in weight corresponded to the amount of oxygen specified by the formula $AgSnOBi_2O_3$. The oxide microparticles which had precipitated in the deformed silver lattice of the oxidized powder particles were evaluated by microscopic observation of polished cross-sections. Upon achievement of complete internal oxidation, the oxide microparticles in the silver lattice were in part in the size range of less than 0.5 microns and in part in particle sizes of 0.5 to 2 microns.

The internally oxidized powder was mixed with 0.2% stearic acid ester as an additive to facilitate the pressing. The internally oxidized powder and a separate layer of silver powder were pressed in an automatic press pressure of 600 MPa to form a two-layer molded contact having a composite contact layer of 2.4 mm and a silver layer of about 0.3 mm thickness. Pressures of from 500 to 900 MPa can also be used. The size of the molded contact was 15×16×2.5 mm.

The pressed contact was then sintered in air at 1023° K. for one hour. By cold-coining at 800 MPa, the contact was further densified. During a second sintering process at 1123° K. for one hour in air, its strength was increased further, and the final shape of the contact was obtained by further coining. The porosity of the final molded two layer contact was less than 2%.

The structure of the contact material prepared in this manner showed in polished cross-section a distinct lattice orientation which was not present when a similar contact was made from unmilled powder of the same composition. It was noted that the degree of orientation could be reduced by increasing the sintering temperature and sintering time and these variations also affected the bending strength. Hence, minimum and maximum acceptable sintering temperatures and times were determined by measuring the bending strength of a contact produced at various sinter times and temperatures. In this test, a contact of a size, 15×16×2.5 mm, was placed on round rods 4 mm in diameter which were secured at a inter rod distance of 12 mm. The contact was loaded in the center by a 2 mm radius bending plunger until fracture occurred. When measuring a 2-layer contact with a silver layer, the silver layer was on the pressure side. Using this test, sintering conditions were chosen so that a minimum acceptable bending strength was obtained. The bending strength of the contact of Example 1 was more than 1400N. In general, the bending strength will increase with increases in the sintering temperature and the sintering time. The acceptable times and temperatures determined in this manner are those given in the foregoing discussion.

The contact properties of the material were measured in a test switch under conditions such as are given in "Z. f. Werkstofftechnik" (*J. of Materials Technology*) 7, pages 381 to 389 (1976), see page 382 in Table 1. The contact of Example 1 had a burnup value of 20 $mm^3$, which is about 30% better than with the contact material of the same composition but formed without milling.

This method also resulted in silver savings of about one third. The contact resistance values were approximately 0.2 m-ohm as the 99.8% value of the distribution curve with the $R_{K1}$ value after closing with chatter, which corresponded to a permissible temperature rise in the switchgear.

EXAMPLE 2

A Silver, Tin Oxide, Bismuth Oxide, Copper Oxide Contact

An AgSnBiCu alloy was processed into alloy powder in the same manner as described in Example 1. After wet milling as in Example 1, the internal oxidation was accomplished in air at 673° K. for six hours and at 873° K. for two hours, whereby a composite powder with the composition $AgSnO_2$-8.76, $Bi_2O_3$-3.57, CuO-0.98 in parts by weight was obtained. The test data were the same as those given in Example 1.

What is claimed is:

1. A process for preparing a composite of about 12 to 25 volume percent of a first metal oxide and about 0.1 to 2 volume percent of a second metal oxide highly dispersed in a remaining volume percent of silver, the first oxide being selected from zinc oxide or tin oxide; and the second oxide being selected from bismuth oxide, lead oxide, copper oxide, indium oxide or a mixture of two or more of said second oxides, which comprises:

(a) atomizing a melt of an alloy of silver, first metal and second metal to form substantially spherically shaped solid alloy particles of less than 0.2 mm in diameter, the first metal being selected from zinc or tin in an amount calculated to yield said volume percent of the first metal oxide when oxidized, and the second metal being selected from bismuth, lead, copper, indium or a mixture of two or more of said second metals in an amount calculated to yield said volume percent of the second metal oxide when oxidized;

(b) milling the spherically shaped alloy particles to reduce their size and deform them into elongated, platlet shaped particles having a thickness substantially less than and a length greater than the spherically shaped alloy particle diameter;

(c) oxidizing the platlet shaped particles by heating in an oxygen containing atmosphere first at a temperature of about 673° K. to about 773° K. for about 2 to 6 hours and then at a temperature of about 873° K. to about 1073° K. for about 0.5 to 2 hours; said milling and said oxidizing in two steps producing a metal oxide-silver dispersion, in which the first and second metal oxide particles are extremely small and highly dispersed;

(d) pressing the oxidized particles to combine them into a unitary solid; and (e) sintering the unitary solid in an air-like atmosphere or a non-oxidizing atmosphere at a temperature of about 973° K. to 1173° K. for about 0.5 to 2 hours to form the composite.

2. A process according to claim 1, which further comprises preparing a two layer electrical contact having a contact layer of the composite and a second layer of a solderable or weldable metal by pressing in step (d) a layer of solderable or weldable metal particles with the oxidized particles to form a two layer solid; and sintering in step (e) the two layer solid in an air-like atmosphere or a non-oxidizing atmosphere at a temperature of about 973° K. to 1173° K. for about 0.5 to 2 hours to form the contact.

3. A process according to claim 1 comprising remilling the oxidized particles before pressing.

4. A process according to claim 2 comprising remilling the oxidized particles before pressing.

5. A process according to claim 1 comprising pressing the oxidized particles at about 500 to 900 MPa.

6. A process according to claim 1 comprising pressing the oxidized particles at about 600 MPa.

7. A process according to claim 1 comprising wet milling the spherically shaped alloy particles in isopropanol in a ball stirrer with steel balls for about 10 to 20 minutes.

8. A process according to claim 1 comprising dry milling the spherically shaped alloy particles in a ball mill for 10 to 30 minutes.

* * * * *